United States Patent [19]

Cha et al.

[11] 4,036,299

[45] July 19, 1977

[54] ENRICHING OFF GAS FROM OIL SHALE RETORT

[75] Inventors: Chang Yul Cha, Bakersfield, Calif.; Richard D. Ridley, Grand Junction, Colo.

[73] Assignee: Occidental Oil Shale, Inc., Grand Junction, Colo.

[21] Appl. No.: 615,558

[22] Filed: Sept. 22, 1975

Related U.S. Application Data

[63] Continuation-in-part of Ser. No. 492,289, July 26, 1974, abandoned.

[51] Int. Cl.[2] ..... E21B 43/24

[52] U.S. Cl. ..... 166/261; 166/259

[58] Field of Search ..... 166/261, 259, 256, 247, 166/260, 272; 299/2; 208/11

[56] References Cited

U.S. PATENT DOCUMENTS

| | | | |
|---|---|---|---|
| 3,113,620 | 12/1963 | Hemminger | 166/247 X |
| 3,196,945 | 7/1965 | Craig, Jr. et al. | 166/261 |
| 3,233,668 | 2/1966 | Hamilton et al. | 166/259 |
| 3,400,762 | 9/1968 | Peacock et al. | 166/259 |
| 3,521,709 | 7/1970 | Needham | 166/259 X |
| 3,548,938 | 12/1970 | Parker | 166/256 |
| 3,577,338 | 5/1971 | Gifford | 208/11 |
| 3,593,789 | 7/1971 | Prats | 166/261 X |
| 3,596,993 | 8/1971 | Busey | 166/261 X |
| 3,605,890 | 9/1971 | Holm | 166/261 |
| 3,661,423 | 5/1972 | Garret | 299/2 |
| 3,892,270 | 7/1975 | Lindquist | 166/261 |

*Primary Examiner*—Stephen J. Novosad

*Attorney, Agent, or Firm*—Christie, Parker & Hale

[57] ABSTRACT

Liquid and gaseous products are recovered from oil shale in an in situ oil shale retort in which a combustion zone is advanced therethrough by a method which includes the steps of establishing a combustion zone in the oil shale in the in situ oil shale retort and introducing a gaseous feed mixture into the combustion zone in the direction the combustion zone is to be advanced through the in situ oil shale retort. The gaseous feed mixture comprises an oxygen supplying gas and water vapor and is introduced into the combustion zone at a rate sufficient to maintain the temperature in the combustion zone within a predetermined range of temperatures above the retorting temperature of the oil shale in the in situ oil shale retort and sufficient to advance the combustion zone through the in situ oil shale retort. The introduction of the gaseous feed mixture into the combustion zone generates combustion products gases which together with the portion of the gaseous feed mixture which does not take part in the combustion process, is called flue gas. The flue gas passes through the oil shale on the advancing side of the combustion zone, thereby retorting the oil shale to produce liquid and gaseous products. The liquid product and the retort off gas, which comprises gaseous product and flue gas, are withdrawn from the in situ oil shale retort at a point on the advancing side of the retorting zone.

47 Claims, 1 Drawing Figure

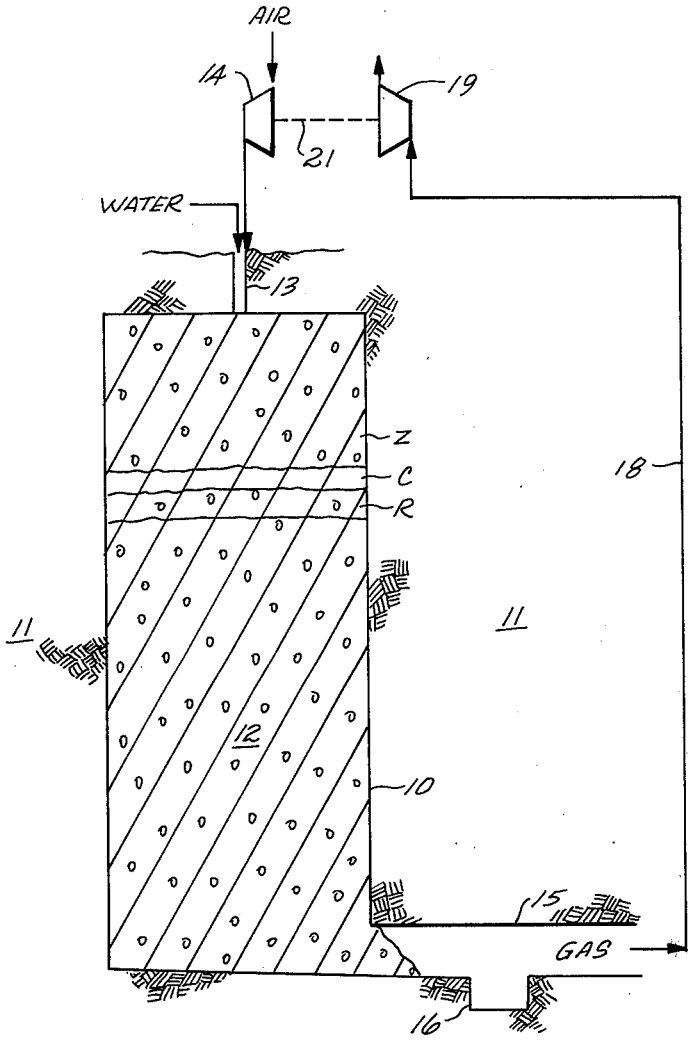
AIR
14
19
21
WATER
13
Z
C
R
18
11
11
12
10
15
GAS
16

ENRICHING OFF GAS FROM OIL SHALE RETORT

BACKGROUND OF THE INVENTION

This application is a continuation-in-part of application Ser. No. 492,289, filed July 26, 1974, now abandoned.

The recovery of liquid and gaseous products from oil shale deposits has been described in several issued patents, one of which is U.S. Pat. No. 3,661,423, issued May 9, 1972 to Donald E. Garrett and assigned to the assignee of this application. This issued patent is directed to the in situ recovery of liquid and gaseous carbonaceous materials from subterranean oil shale deposits and describes the fragmentation of oil shale in a subterranean oil shale deposit to form a stationary body of fragmented oil shale within the deposit, referred to herein as an in situ oil shale retort. This patent also describes the movement of hot retorting gases through the in situ oil shale retort to convert kerogen contained in the oil shale in the in situ oil shale retort to liquid and gaseous products.

One method of supplying the hot retorting gases required for converting kerogen contained in the oil shale in the in situ oil shale retort to liquid and gaseous products, as described in the U.S. Pat. No. 3,661,423, includes the establishment of a combustion zone in the in situ oil shale retort and the movement of an oxygen supplying gaseous feed mixture downwardly through the combustion zone to advance the combustion zone downwardly through the in situ oil shale retort. In the combustion zone, the oxygen in the gaseous feed fixture is depleted by reaction with hot carbonaceous materials to produce heat and a combustion products gas, which together with the portion of the gaseous feed mixture which does not take part in the combustion process is called flue gas. The reaction of oxygen in the gaseous feed mixture with hot carbonaceous materials depends on contact with the hot carbonaceous materials and can occur over a wide spread of temperature in the in situ oil shale retort. By the continued introduction of the oxygen supplying gaseous feed mixture downwardly into the combustion zone, the temperature zone in the combustion zone having the highest temperature is advanced downwardly through the in situ oil shale retort.

The downward movement of the flue gases through the in situ oil shale retort on the advancing side of the combustion zone heats the oil shale to a temperature sufficient to produce kerogen decomposition, called retorting, in the oil shale to gaseous and oil mist products and a residue product of solid carbonaceous material. The oil mist product and some of the gaseous products condense on the cooler oil shale fragments in the retort and, together with water formed during combustion, are collected at the bottom of the retort. Thus, the products of retorting are referred to as liquid and gaseous products herein.

The residue product can be used as fuel for advancing the combustion zone through the retorted oil shale.

When the residue product is heated to combustion temperature it reacts with oxygen. The location where the oxidation reaction with the greater part of the oxygen in the gaseous feed mixture occurs is called the combustion zone. It is characterized by a temperature which is higher than in other parts of the in situ retort. The zone where the oxidation reaction with the residue product is most concentrated will exhibit the highest temperature in the combustion zone and is called the maximum temperature zone. As the carbonaceous residue product becomes depleted in the combustion process, the oxygen penetrates further down in the in situ oil shale retort where it combines with still unoxidized carbonaceous residue product thus causing the combustion zone to move downwardly through the fragmented oil shale in the in situ retort.

The retorting zone, the place where retorting takes place, is removed from the maximum temperature zone by a distance which is dependent on the temperature of the maximum temperature zone and the volume of flue gases per unit cross-sectional area proceeding from the maximum temperature zone. The rate of retorting of the oil shale to liquid and gaseous products is temperature dependent. At a temperature of from about 600° F to about 750° F, the kerogen in the oil shale is retorted at a low rate; at a temperature of from about 750° F to about 900° F, the retorting of oil shale is at a moderate rate; and at a temperature of from about 900° F to about 1150° F, and higher, the retorting of oil shale is at a rapid rate. As the retorting of a segment of the fragmented oil shale in the retorting zone progresses and less heat is extracted from the flue gases passing therethrough, the gases heat the oil shale at a lower level to retorting temperatures, thus moving the retorting zone downwardly on the advancing side of the combustion zone.

In one method of supplying heat to the retorting zone, the combustion zone is maintained at a temperature of about 1600° F to about 1800° F by moving a gaseous feed mixture comprising air and retort off gas downwardly through the combustion zone.

At such high temperatures, a portion of the inorganic carbonates in the oil shale are converted to carbon dioxide which dilutes the gaseous products from the retorting of kerogen in the oil shale. Off gas diluted with such carbon dioxide may not have sufficient heating value to be combustible or useful in a work engine. Additionally, the conversion of inorganic carbonates to carbon dioxide requires heat. This heat is supplied by the heat from the combustion zone and requires the combustion of an excess of retorting residue product and reduces the quantity thereof which would otherwise remain in the spent in situ oil shale retort for possible recovery by secondary recovery methods. Such high temperatures require the movement of a greater volume of gaseous feed mixture through the in situ oil shale retort than is required at lower temperature for advancing the retorting zone through the in situ oil shale retort.

SUMMARY OF THE INVENTION

The present invention is directed to a method of retorting fragmented oil shale in an in situ retort comprising: establishing a combustion zone in the fragmented oil shale in an in situ oil shale retort; introducing into the combustion zone, in the direction in which the combustion zone is to be advanced, a gaseous feed mixture comprising an oxygen supplying gas and water vapor; generating combustion products gases in the combustion zone, which together with unreacted feed mixture gases form a flue gas which passes through the retort in the direction of the advancement of the combustion zone, thereby retorting the oil shale on the advancing side of the combustion zone to produce liquid and gaseous products. Liquid product and retort off gas comprising gaseous products and flue gases are withdrawn from the in situ oil shale retort at a point on the advancing side of the combustion zone.

This invention provides a method for retorting fragmented oil shale in an in situ oil shale retort by which the temperature of the combustion zone can be controlled, heat is more efficiently transferred from the combustion zone to fragmented oil shale in the retorting zone, the yield of liquid product is increased, and the heating value of the off gas is improved. The volume of water withdrawn from the in situ oil shale retort is greater than the volume of water attributable to combustion and retorting and can be attributed to condensation of water vapor on the oil shale on the advancing side of the retorting zone. The quantity of water vapor in the retort off gas is less than the water vapor introduced into the in situ oil shale retort and the water which is attributable to retorting and combustion. The reduced quantity of water vapor can be attributed to condensation of water vapor on unretorted oil shale on the advancing side of the retorting zone and the separation of water vapor from gases in the in situ oil shale retort. These and other features and advantages of the present invention will be appreciated as same becomes better understood by reference to the following detailed description of this retorting method of recovering liquid and gaseous products from an in situ oil shale retort when considered in connection with the accompanying drawing which illustrates schematically in vertical cross section an in situ oil shale retort operated in accordance with principles of this retorting method.

THE DRAWING

The drawing illustrates an in situ oil shale retort in the form of a cavity 10 formed in unfragmented oil shale 11 and filled with a body or rubble pile of expanded or fragmented oil shale particles 12. The cavity 10 and body of oil shale particles can be created simultaneously by blasting by any of a variety of techniques. A method of forming an in situ oil shale retort is described in the U.S. Pat. No. 3,661,423.

A conduit 13 communicates with the top of the bed of oil shale particles in the in situ oil shale retort and means such as a compressor 14 is connected thereto for providing compressed air as indicated schematically in the drawing. A tunnel 15 is in communication with the bottom of the retort and contains a sump 16 in which liquid product is collected and from which it is withdrawn through conduit means, not shown. Retort off gas comprising flue gas and gaseous product is also recovered from the retort by way of the tunnel 15. Gaseous feed mixture comprising air or other oxygen supplying gas and water vapor is introduced into the retort through the conduit 13. The gaseous feed mixture flows downwardly into the combustion zone C. The flue gases therefrom also flow downwardly through the body of fragmented oil shale particles 12 and together with retort product gases are withdrawn through tunnel 15 through conduit means, not shown.

DESCRIPTION

When the retorting is carried out in accordance with the method of this invention, the oil shale is ignited by any known method as, for example, the method described in the U.S. Pat. No. 3,661,423 or U.S. Patent Aplication, Ser. No. 536,371 filed Dec. 26, 1974 by Chang Yul Cha and assigned to the assignee of this invention, and gaseous feed mixture is introduced downwardly into the retort. A combustion zone C is established which slowly moves downwardly and the flue gases transfer heat from it to a retorting zone R where the oil shale is heated for retorting the kerogen to liquid and gaseous products. A substantial zone Z above the combustion zone has an elevated temperature due to passage of the combustion zone therethrough. This zone Z of heated spent shale in the wake of the moving combustion zone is gradually cooled by flow of gaseous feed mixture therethrough, but generally increases in thickness as retorting continues. There is a substantial amount of retorting residue product, generally in the form of unburned residual carbon, in the zone of hot spent shale and at least a portion of this carbon can react with oxygen in the gaseous feed mixture prior to the gaseous feed mixture reaching the maximum temperature zone in the combustion zone.

After passing the combustion zone, the gaseous mixture is substantially free of oxygen and is made up of nitrogen, carbon dioxide, carbon monoxide, hydrogen, water vapor, methane and traces of other hydrocarbons and argon. In retort operations utilizing a gaseous feed mixture comprising air and retort off gas, the heating value of fuel value of the retort off gas can be relatively low, in the order of about 20 to 60 BTU/SCF (standard cubic foot). Such retort off gas is of marginal value, if usable at all, for use in a work engine to generate power, and if it is used, it may be necessary to augment the retort off gas with other combustible material.

It is found in the practice of this method of recovering liquid and gaseous products from an in situ oil shale retort that by addition of water vapor or water to the retort, the heating value of the off gas can be from about 50 to about 100 BTU/SCF or higher. The retort off gas removed from the bottom of the retort can be conveyed by line 18 for combustion in a work engine such as a gas turbine 19. The mechanical power from the gas turbine is coupled to the compressor 14 used for supplying air or gaseous feed mixture to the retort as indicated by the dashed line 21. For lowest losses it is preferred to couple the compressor and turbine directly by a mechanical linkage, however, it will be apparent that for greater flexibility in operation, it may be desirable to connect the gas turbine to a generator and employ an electric motor on the compressor.

In the arrangement illustrated in the drawing, water is introduced through the conduit 13 with the air supplied to the top of the retort. The water can be added as a liquid by spraying it in the top of the retort or through the conduit, or it can first be vaporized and added in the form of steam or water vapor in the inlet air. Water may also enter an in situ retort by leakage from aquifiers in the unfragmented shale. Such water can be accounted for in making further additions of water or water vapor. When water is added near the top of the in situ oil shale retort, it is vaporized by the residual heat in the hot spent shale in the zone Z above the combustion zone, cooling the spent shale. Therefore, only a limited quantity of water can be vaporized before the temperature of the spent shale at the top of such retort is reduced below the vaporization temperature of water. When the temperature of the spent shale at the top of the in situ oil shale retort is reduced to a temperature below the boiling point of water, water added to the top of such retort can be absorbed by the spent shale instead of passing through the retort to a hotter portion thereof where it could be vaporized. It is therefore a preferred embodiment of this invention to introduce water into the in situ retort in the form of water vapor at a temperature of from about 200° F to about 500° F.

In the method of this invention, a gaseous feed mixture is introduced into the combustion zone in the direction in which the combustion zone is to be advanced where it reacts with carbonaceous material to generate the heat required for retorting oil shale in a retorting zone on the advancing side of the combustion zone, which is also advanced in the same direction. In the retorting zone, kerogen in oil shale is converted to liquid and gaseous products. The gaseous feed mixture comprises an oxygen supplying gas and water vapor and is introduced into the combustion zone at a rate sufficient to maintain the combustion zone within a predetermined range of temperatures above the retorting temperature of the oil shale in the in situ oil shale retort and to advance the combustion zone through the in situ oil shale retort. Flue gases which comprise combustion product gases generated in the combustion zone together with unreacted feed gases, the gases of the gaseous feed mixture which do not enter into the combustion reaction, flow from the combustion zone in the direction of advancement of the combustion zone and pass through the in situ oil shale retort on the advancing side of the combustion zone, thereby retorting the oil shale to liquid and gaseous products. At the point of retorting, the retorting products are generally in their gaseous or mist forms and as the retorting products move to cooler zones in the in situ oil shale retort, a portion of the retorting products condense to produce liquid products and the water vapor can condense on unretorted oil shale on the advancing side of the retorting zone, thereby separating the water vapor from other gases in the retort. The water, liquid product and retort off gas which comprises gaseous product and flue gas are withdrawn from the in situ oil shale retort at a point on the advancing side of the retorting zone.

In establishing a combustion zone by the method described in the 536,371 application, an inlet conduit is provided to the upper boundary of an in situ oil shale retort, a combustible gaseous feed mixture is introduced therethrough and ignited in the in situ oil shale retort. Retort off gas is withdrawn through an outlet means extending from the lower boundary of the retort, thereby bringing about a movement of gases from top to bottom of the in situ oil shale retort through the fragmented oil shale therein. A combustible gaseous feed mixture of a fuel, such as propane, butane, natural gas, or retort off gas, and an oxygen supplying gas such as air is introduced through the inlet conduit to the upper boundary of the in situ oil shale retort and is ignited to initiate a combustion zone at or near the upper boundary. Combustible gaseous feed mixtures of oxygen supplying gases and other fuels are also suitable for ignition purposes. The supply of the combustible gaseous feed mixture to the combustion zone is maintained for a period sufficient for the oil shale at the upper boundary of the retort to become heated to a temperature higher than the spontaneous combustion temperature of carbonaceous materials in the oil shale and generally higher than about 900° F, so that the combustion zone can be maintained by the introduction of oxygen supplying gas without fuel. At a temperature higher than about 900° F, gases passing through the combustion zone and the combustion product gases are heated to a temperature sufficient to rapidly retort oil shale on the advancing side of the combustion zone. The period of establishing a combustion zone can be from about one day to about a week in duration. The temperature in the combustion zone can be determined with the aid of a thermocouple inserted therein or by other known means. When a zone of oil shale has been heated to a temperature sufficient to support combustion of the carbonaceous material in the oil shale in the presence of the gaseous feed mixture (without a hydrocarbon fuel), oxygen in the gaseous feed mixture will be depleted from the gaseous feed mixture as the gaseous feed mixture is moved through the combustion zone. This reduction in oxygen concentration is evidenced by the composition of the retort off gas, which will have a low or no oxygen content.

Preferably, the oxygen concentration in the gaseous feed mixture and the rate of its introduction into the combustion zone are adjusted such that substantially all of the oxygen in the gaseous feed mixture reacts with carbonaceous materials in the combustion zone.

Control of the advancement of the combustion zone is accomplished by introducing into the combustion zone, in the direction of the advancement of the combustion zone through the in situ oil shale retort, a gaseous feed mixture comprising an oxygen supplying gas and water vapor so as to maintain the maximum temperature in the combustion zone within a predetermined range of temperatures. The gaseous feed mixture is introduced into the combustion zone at a rate sufficient to maintain the maximum temperature in the combustion zone at a temperature above the retorting temperature of the oil shale and to advance the combustion zone through the in situ oil shale retort.

Suitable oxygen supplying gases are air or oxygen, or a mixture of oxygen with air or other gases.

Retorting of oil shale can be carried out at a combustion zone temperature as low as 800° F, however, in order to have retorting at a substantial rate, it is preferred to maintain the combustion zone at least at about 950° F. A combustion zone temperature of 800° F or higher is sufficient for spontaneous ignition of carbon, the major component of the residue from the retorting of oil shale. The upper limit on the temperature in the combustion zone is determined by the fusion temperature of the oil shale, which is about 2100° F. The temperature in the combustion zone is maintained below about 1800° F to provide a margin of safety between the temperature in the combustion zone and the fusion temperature of oil shale. An embodiment of this invention, therefore, is to carry out the retorting process at a combustion zone temperature of from about 950° F to about 1800° F.

The inorganic carbonates in the oil shale are carbonates of calcium and magnesium, which decompose endothermically when heated to their decomposition temperatures. The endothermic decomposition of these inorganic carbonates consumes heat generated in the combustion zone, thereby requiring the generation of heat in addition to that required for retorting the oil shale in the in situ oil shale retort. The carbon dioxide produced in the decomposition of the inorganic carbonates dilutes the gaseous retorting products so that the retort off gas may not have sufficient heating value to be combustible or useful in a work engine.

The decomposition of calcium carbonate, which can be considered as constituting a major portion of the inorganic carbonates in oil shale, is temperature dependent. At a temperature of about 1200° F, calcium carbonate decomposes at a low rate, and at a temperature of above about 1400° F, calcium carbonate decomposes at a rapid rate. Therefore, to reduce the heat consumed by the decomposition of inorganic carbonates in oil shale and to reduce the dilution of gaseous retorting products with carbon dioxide, the combustion zone is maintained at a temperature of less than about 1400° F.

At a combustion zone temperature of about 1100° F, a fairly good retorting rate can be maintained in an in situ retort and, therefore, a preferred embodiment of this invention is to carry out the in situ retorting at a combustion zone temperature of from about 1100° F to about 1400° F.

In balancing a good retorting rate against a tolerable amount of carbonate decomposition, good results are obtained when the combustion zone is maintained at a temperature of from about 1200° F to about 1300° F, and this temperature range constitutes an especially preferred embodiment of this invention.

The combustion of carbonaceous materials and the generation of heat thereby depends on the contact of oxygen with the carbonaceous materials. In a zone in the in situ oil shale retort having a low carbonaceous material content, the heat generated per unit volume at a gaseous feed mixture introduction rate and oxygen concentration would be less than can be generated per unit volume in a zone having a higher carbonaceous material content. The concentration of carbonaceous materials available for combustion in various zones throughout the in situ oil shale retort can be determined by a method such as conducting assays of core samples taken from the various zones. These determinations of the carbonaceous materials available for combustion can be used to calculate the quantity of heat which can be generated per unit volume in the various zones in the in situ retort.

Oil shale is a poor heat conductor, therefore, heat generated in a zone in an in situ oil shale retort remains within the zone and increases the temperature of oil shale within the zone. However, by the method described in this application, gases are moved through the combustion zone in the direction of the advancement of the combustion zone through the in situ oil shale retort. The movement of these gases through the in situ oil shale retort transfers heat from the combustion zone to the oil shale on the advancing side of the combustion zone. This transfer of heat from the combustion zone controls in part the temperature in the combustion zone.

It is found that water vapor has a higher heat capacity than air and can carry more heat per unit volume from the combustion zone to the oil shale in the retorting zone than a gas, such as retort off gas, having a lower heat capacity. The transfer of heat is more rapid and reduces the temperature of the oil shale on the trailing side of the maximum temperature zone in the combustion zone and increases the temperature on the advancing side of the retorting zone to produce a broader retorting zone temperaure profile in the in situ oil shale retort than when gases with lower heat capacities are used.

It is also found that the use of water vapor reduces the temperature differential between the combustion and the retorting zone. The reduction in temperature differential permits a reduction in the combustion zone temperature while maintaining the retorting zone temperature. The conversion of inorganic carbonates in the oil shale to carbon dioxide can thus be reduced, and the retort off gas will have a higher heating value and less carbonaceous material will be used in the retorting of the in situ oil shale retort.

With the use of water vapor in the gaseous feed mixture, it is noted that the yield of liquid product and the liquid product production rate are higher than when gases having lower heat capacities, such as retort off gas, are used to the exclusion of water vapor in the gaseous feed mixture. It is thought that the improved heat transfer from the combustion zone provides for more complete retorting of the oil shale to liquid product prior to the advancement of the combustion zone through the retorted oil shale and for a faster rate of advancement of the combustion zone through the in situ oil shale retort.

The quantity of water recovered from an in situ oil shale retort and the quantity of water vapor in the retort off gas recovered from an in situ oil shale retort while using water vapor as a component of the gaseous feed mixture indicates that water vapor condenses from the gas in the in situ oil shale retort. The unretorted oil shale in the in situ oil shale retort on the advancing side of the retorting zone is at the ambient temperature of the oil shale retort prior to establishing the combustion zone in the retort and is below the boiling temperature of water. Therefore, a portion of the water vapor can condense on the unretorted oil shale. During the condensation of the water vapor on the unretorted oil shale, the heat of condensation of the water vapor is transferred to the unretorted oil shale. This heat can vaporize water in the oil shale on the advancing side of the retorting zone and reduce the emulsion formation which occurs when water is vaporized in the retorting zone. Additionally, the condensation of water vapor can supply heat to break emulsion which can be formed in the in situ oil shale retort.

The heat capacity of the gaseous feed mixture is improved by including in the gaseous feed mixture a water vapor concentration of from about 10 to about 90 percent by volume of the gaseous feed mixture and this constitutes an embodiment of this invention. The heat capacity is significantly improved by including in the gaseous feed mixture a water vapor concentration of from about 20 to about 40 percent by volume of the gaseous feed mixture and a gaseous feed mixture containing this range of amounts of heat transfer gas constitutes a preferred embodiment of this invention. A concentration of water vapor higher than about 40 percent by volume further increases the heat capacity of the gaseous feed mixture and is useful for improving the heat transfer characteristics of the gaseous feed mixture.

When air is used as the oxygen supplying gas, the water vapor can be used as the only diluent and can be mixed with air to provide a gaseous feed mixture. A gaseous feed mixture consisting of from about 50 to about 10 parts by volume of water vapor and from about 50 to about 90 parts by volume air per 100 parts by volume gaseous mixture provides a gaseous feed mixture having from about 10.5 to about 18.9 parts by volume oxygen per 100 parts by volume of gaseous feed mixture. The use of this gaseous feed composition constitutes an embodiment of this invention. A gaseous feed mixture consisting of from about 40 to about 30 parts by volume of water vapor and from about 60 to about 70 parts by volume air per 100 parts by volume of a gaseous feed mixture provides a gaseous feed mixture having from about 12.6 to about 14.7 parts by volume oxygen per 100 parts by volume of gaseous feed mixture. The use of such a gaseous feed composition constitutes a preferred embodiment of this invention. Water vapor is not an oxygen supplying gas in the retorting of oil shale.

In other embodiments, a gaseous feed mixture consisting of from about 52 to about 30 parts by volume of water vapor and from about 48 to about 70 parts by volume air per 100 parts by volume gaseous feed mixture provides a gaseous feed mixture having from about 10 to about 15 parts by volume oxygen per 100 parts by volume of gaseous feed mixture. The use of this gaseous feed composition constitutes an embodiment of this invention. A gaseous feed mixture consisting of from about 43 to about 30 parts by volume of water vapor and from about 57 to about 70 parts by volume air per 100 parts by volume of a gaseous feed mixture provides a gaseous feed mixture having from about 12 to about 15 parts by volume oxygen per 100 parts by volume of gaseous feed mixture. The use of such a gaseous feed composition constitutes a preferred embodiment of this invention.

The water vapor and the oxygen supplying gas should be substantially homogeneously mixed prior to introduction into the combustion zone. This can be accomplished by any of a number of methods, one of which is the mixing of the gases to form the gaseious feed mixture prior to introducing the gaseous feed mixture into the in situ oil shale retort. Water can be dispersed in the oxygen supplying gas and the water vaporized after the mixture is introduced into the in situ oil shale retort.

As mentioned above, water introduced into an in situ oil shale retort and vaporized therein will consume sensible heat and the temperature of the in situ oil shale retort at the water inlet can be reduced below the boiling point of water. Thereafter, water will be absorbed by the oil shale having a temperature lower than the boiling point of water and the absorbed water will not vaporize or move to the combustion zone. It is therefore preferred to add water in the form of water vaor or steam. Steam at temperatures above about 200° F can be mixed with air to form the gaseous feed mixture used in this invention. An embodiment of this invention is to use steam having a temperature of from about 300° F to about 500° F in the preparation of the gaseous feed mixture.

In an exemplary embodiment of this invention, about 30 parts by volume of steam at about 15 Psia and about 300° F is mixed with about 70 parts by volume air at about 15 Psia and about 100° F to produce a gaseous feed mixture having a temperature of about 170° F at about 15 Psia. This gaseous feed mixture is introduced into a combustion zone having a temperature of from about 1200° F to about 1300° F in an in situ oil shale retort at about 0.75 SCFM per square foot of cross-sectional area of the retort being retorted. Liquid and gaseous products are collected and removed from the bottom of the retort.

The oxygen concentration required for maintaining the temperature in the combustion zone at a temperature above the retorting temperature of oil shale in the in situ oil shale retort is greater than about 5 percent oxygen by volume of the gaseous feed mixture. At an oxygen concentration of greater than about 20 percent by volume of the gaseous feed mixture, the contact of the gaseous feed mixture with concentrated zones of carbonaceous materials in the in situ oil shale retort can cause localized fusion of oil shale. Fusion of oil shale can restrict the movement of the gaseous feed mixture through the in situ oil shale retort. Therefore, an embodiment of this invention is to use a gaseous feed mixture having from about 5 to about 20 percent oxygen by volume. Maintenance of the oxygen concentration at less than about 15 percent by volume of the gaseous feed mixture provides a margin of safety to prevent fusion of oil shale on contact of oxygen in the gaseous feed mixture with concentrated zones of carbonaceous material. At an oxygen concentration of at least about 10 percent by volume of the gaseous feed mixture, the maximum temperature in the combustion zone can be readily adjusted to a predetermined temperature above the retorting temperature of the oil shale in the in situ oil shale retort. The use of a gaseous feed mixture having from about 10 to about 15 percent oxygen by volume, therefore, constitutes a preferred embodiment of this invention. In order to be able to readily maintain a combustion zone at a predetermined temperature above the retorting temperature of the oil shale in the in situ oil shale retort and below the fusion temperature of the oil shale it is especially preferred to use a gaseous feed mixture having from about 12 to about 15 parts oxygen by volume.

The rate of introduction of the gaseous feed mixture into the combustion zone is at least about 0.1 Standard Cubic Foot of gaseous feed mixture per minute (SCFM) per square foot of cross-sectional area of the in situ oil shale being retorted so as to cause the maximum temperature zone in the combustion zone to advance through the in situ oil shale retort. In order to cause the maximum temperature zone to advance through the in situ oil shale retort at about 0.5 to 2 feet per day, depending on the kerogen content of the oil shale through which the combustion zone is advancing, the gaseous mixture in introduced into the combustion zone at a rate of at least about 0.5 SCFM per square foot of the cross-sectional area of the in situ oil shale being retorted. Introduction of gaseous feed mixture into the combustion zone at greater than about 2 SCFM per square foot of cross-sectional area of the in situ oil shale retort can carry a portion of the oxygen through an established or desired combustion zone location and into the retorting zone. In the retorting zone, the oxygen can contact retorting products and unretorted carbonaceus material in the oil shale and, by a combustion reaction therewith, destructively decompose the retorting products and unretorted carbonaceous materials. Therefore, an embodiment of this invention is to introduce a gaseous feed mixture into the combustion zone at a rate of from about 0.1 to about 2 SCFM per square foot of cross-sectional area of the in situ oil shale being retorted.

A preferred embodiment of this invention is to introduce the gaseous feed mixture into the combustion zone at from about 0.5 to about 1 SCFM per square foot of cross-sectional area of the in situ oil shale being retorted, as then a substantial portion of the oxygen in the gaseous feed mixture contacts heated carbonaceous material in the combustion zone and in the heated oil shale on the trailing side of the combustion zone.

The use of water vapor in the gaseous feed mixture can also influence the reactions in the combustion zone. Water can react with carbon in the retorting zone, in the combustion zone or in the heated volume trailing the combustion zone to generate carbon monoxide, carbon dioxide, and hydrogen by the water gas reaction. The presence of water vapor also influences the depth of carbon consumption in the particles of oil shale, since the diffusivity of water vapor is greater than that of oxygen. The endothermic water gas reactions proceed inside the particles of oil shale in the combustion zone at the same time that oxygen is exothermally reacting with the hydrogen and carbon monoxide produced by the water gas reaction and with retorting residue. The exothermic reaction of oxygen with hydrogen and carbon monoxide produced in the water gas reaction produces water vapor and carbon dioxide and in part supplies heat to balance the endothermic water gas reactions. Water vapor in the gaseous mixture provides maximum benefits from the retorting residue in the in situ oil shale retort as the combustion zone is advanced downwardly through the in situ oil shale retort.

The water reacts with carbon in the hot shale by well known water gas reaction $$H_2O + C = H_2 + CO.$$

Ordinarily, this reaction occurs when water contacts carbon heated to a temperature above about 1200° F. It is thought that the residual carbon remaining as retorting residue product in the spend shale is in a highly active form and it is hypothesized that the water gas reaction can occur at a somewhat lower temperature because of the high reactivity of the residual carbon. In any event, the temperatures in and near the maximum temperature zone in the combustion zone can be sufficiently high that the water gas reaction proceeds. Temperatures in the retorting zone can also be high enough for the water gas reaction to take place with residual carbon. The reaction may proceed at lower than expected temperatures because of concurrent retorting of kerogen in the oil shale to liquid and gaseous products in the retorting zone. Tests shown that the heating value of the off gas is substantially enhanced by addition of water vapor to the combustion zone in the in situ oil shale retort and a water gas reaction is a known mechanism for achieving this. It is believed that the water gas reaction occurs in the zone of heated spent shale trailing the maximum temperature zone in the combustion zone, in the maximum temperature zone, and in the retorting zone on the advancing side of the maximum temperature zone.

When the water gas reaction occurs in the heated shale zone trailing the maximum temperature zone in the combustion zone, the resulting gases can react with oxygen in the in situ oil shale retort. The same will be true in the maximum temperature zone in the combustion zone although if the temperature is high enough the reaction $$CO_2 + C = 2\,CO$$

may also occur to keep the carbon monoxide level high in the presence of excess carbonaceous material. On the advancing side of the maximum temperature zone in the combustion zone, water gas production can enhance the fuel value of the retort off gas. By adding water vapor in the zone of hot spent shale trailing the maximum temperature zone in the combustion zone, one assures flow of water vapor concurrent with flue gases produced in the combustion zone with sequential contacting of spent shale, shale in the maximum temperature zone in the combustion zone and heated shale in a retorting zone where kerogen is being retorted. By having at least part of the water gas reaction occurring in the retorting zone, a sufficient enhancement of the fuel value of the retort off gas is obtained to make it useful in a working engine.

In an exemplary embodiment in the practice of this invention, an off gas with a heating value of about 65 BTU/SCF is produced in an in situ oil shale retort having a cross-sectional area of about 1000 square feet and a height of about 100 feet. Water flow is about two gallons per minute but is not precisely measured because of the contribution by leakage into the retort from underground aquifers.

In another exemplary embodiment, in an in situ oil shale retort which is about 30 feet square and has a height of about 100 feet, a comparison is made between the use of water vapor and the use of recycle gas as a diluent for air in the gaseous feed mixture being used for advancing a combustion zone through the in situ oil shale retort. It is estimated that the maximum temperature zone in the combustion zone is moving through a zone in the in situ oil shale retort which could yield on retorting about thirty gallons of shale oil per ton of oil shale. The gaseous feed mixture is introduced into the combustion zone at about 0.62 SCFM/ft$^2$ and the oxygen constitutes about 14.7 percent by volume of the gaseous feed mixture. During the period when the water vapor is used as the diluent, the oil yield is about 84 percent as compared to the oil yield of about 79 percent when retort off gas is used as the diluent. When water vapor is used as the diluent, the oil production is about 48 barrels per day and the fuel value of the retort off gas is about 75 BTU/SCF as compared to an oil production of about 24 barrels/day and a fuel value of the retort off gas of about 47 BTU/SCF when retort off gas is used as the diluent. It is also estimated that the maximum temperature zone in the combustion zone has a temperature of about 1700° F and advances through the in situ oil shale retort at about 1.45 ft/day when water vapor is used as the diluent as compared to a temperature of about 1800° F and an advancement rate of about 1.10 ft/day when retort off gas is used as the diluent.

Wherever in this specification the temperature of a combustion zone is mentioned, it is the maximum temperature in the combustion zone that is being referred to.

It will be apparent that many widely different embodiments of this invention may be made without departing from the spirit and scope thereof; therefore, it is not intended that this invention be limited except as indicated in the appended claims.

What is claimed is:

1. A method of recovering liquid and gaseous products from fragmented oil shale in an in situ oil shale retort in which a combustion zone is advanced therethrough, which comprises the steps of:

establishing a combustion zone having a temperature higher than about 800° F in the fragmented oil shale in the in situ oil shale retort;

introducing into said combustion zone, in the direction in which said combustion zone is to be advanced, a gaseous feed mixture comprising an oxygen supplying gas and water vapor at a rate sufficient to maintain the temperature in said combustion zone at a temperature higher than about 800° F and to advance said combustion zone through the in situ oil shale retort, and producing combustion product gases in said combustion zone;

passing flue gas, comprising said combustion product gases and unreacted gaseous feed mixture gases, from the combustion zone through the fragmented oil shale in the in situ retort in the direction of the advancement of said combustion zone, thereby retorting oil shale in a retorting zone on the advancing side of said combustion zone to produce liquid and gaseous products;

condensing water vapor on unretorted oil shale on the advancing side of the retorting zone to form liquid water; and withdrawing liquid water, said liquid product and retort off gas comprising said gaseous products and said flue gas from the in situ oil shale retort on the advancing side of said combustion zone.

2. The method of claim 1 wherein oxygen provided by the oxygen supplying gas comprises greater than about 5 percent by volume of said gaseous feed mixture.

3. The method of claim 1 wherein oxygen provided by the oxygen supplying gas comprises from about 10 to about 15 percent by volume of said gaseous feed mixture.

4. The method of claim 1 wherein oxygen provided by the oxygen supplying gas comprises from about 12 to about 15 percent by volume of said gaseous feed mixture.

5. The method of claim 1 wherein said oxygen supplying gas is air.

6. The method of claim 1 wherein said water vapor comprises from about 10 to about 90 percent by volume of said gaseous feed mixture.

7. The method of claim 1 wherein said gaseous feed mixture is introduced into said combustion zone at a rate sufficient to bring about the retorting of the oil shale on the advancinng side of said combustion zone and produce retorted oil shale prior to the passage of said combustion zone therethrough.

8. The method of claim 1 wherein said gaseous feed mixture is introduced into said combustion zone at from about 0.1 to about 1 Standard Cubic Foot per minute per square foot of cross-sectional area of the in situ oil shale being retorted.

9. The method of claim 1 wherein said combustion zone is maintained at a temperature lower than the rapid decomposition temperature of carbonates in the oil shale.

10. The method of claim 1 wherein said combustion zone is maintained at a temperature lower than about 1400° F.

11. The method of claim 1 wherein the temperature in said combustion zone is maintained at a temperature of from about 950° F to about 1800° F.

12. A method of recovering liquid and gaseous products from fragmented oil shale in an in situ oil shale retort in which a combustion zone is advanced therethrough, which comprises the steps of:

establishing a combustion zone in the fragmented oil shale in the in situ oil shale retort;

introducing into said combustion zone, in the direction in which said combustion zone is to be advanced, a gaseous feed mixture comprising an oxygen supplying gas and water vapor at a rate sufficient to maintain the temperature in said combustion zone at a temperature higher than the retorting temperature of the oil shale in the in situ oil shale retort and to advance said combustion zone through the in situ oil shale retort, and producing combustion product gases in said combustion zone, and wherein said water vapor comprises from about 10 to about 50 percent by volume of said gaseous feed mixture;

passing flue gas, comprising said combustion product gases and unreacted gaseous feed mixture gases, from the combustion zone through the fragmented oil shale in the situ retort in the direction of the advancement of said combustion zone, thereby retorting oil shale in a retorting zone on the advancing side of said combustion zone to produce liquid and gaseous product; and withdrawing said liquid product and retort off gas comprising said gaseous products and said flue gas from the in situ oil shale retort on the advancing side of said retorting zone.

13. A method of recovering liquid and gaseous products from fragmented oil shale in an in situ oil shale retort in which a combustion zone is advanced therethrough, which comprises the steps of:

establishing a combustion zone in the fragmented oil shale in the in situ oil shale retort;

introducing into said combustion zone, in the direction in which said combustion zone is to be advanced, a gaseous feed mixture comprising an oxygen supplying gas and water vapor at a rate sufficient to maintain the temperature in said combustion zone at a temperature higher than the retorting temperature of the oil shale in the in situ oil shale retort and to advance said combustion zone through the in situ shale retort, and producing combustion product gases in said combustion zone, and wherein said water vapor comprises from about 20 to about 40 percent by volume of said gaseous feed mixture;

passing flue gas, comprising said combustion product gases and unreacted gaseous feed mixture gases, from the combustion zone through the fragmented oil shale in the in situ retort in the direction of the advancement of said combustion zone, thereby retorting oil shale in a retorting zone on the advancing side of said combustion zone to produce liquid and gaseous product; and withdrawing said liquid product and retort off gas comprising said gaseous products and said flue gas from the in situ oil shale retort on the advancing side of said retorting zone.

14. A method of recovering liquid and gaseous products from fragmented oil shale in an in situ oil shale retort in which a combustion zone is advanced therethrough, which comprises the steps of:

establishing a combustion zone in the fragmented oil shale in the in situ oil shale retort;

introducing into said combustion zone, in the direction in which said combustion zone is to be advanced, a gaseous feed mixture comprising an oxygen supplying gas and water vapor at a rate sufficient to maintain the temperature in said combustion zone at a temperature higher than the retorting temperature of the oil shale in the in situ oil shale retort and to advance said combustion zone through the in situ oil shale retort, and producing combustion product gases in said combustion zone, and wherein said gaseous feed mixture is introduced into said combustion zone at from about 0.1 to about 2 Standard Cubic Feet per minute per square foot of cross-sectional area of the fragmented oil shale being retorted;

passing flue gas, comprising said combustion product gases and uneacted gaseous feed mixture gases, from the combustion zone through the fragmented oil shale in the in situ retort in the direction of the advancement of said combustion zone, thereby retorting oil shale in a retorting zone on the advancing side of said combustion zone to produce liquid and gaseous product; and withdrawing said liquid product and retort off gas comprising said gaseous products and said flue gas from the in situ oil shale retort on the advancing side of said retorting zone.

15. A method of recovering liquid and gaseous products from fragmented oil shale in an in situ oil shale retort in which a combustion zone is advanced therethrough, which comprises the steps of:

establishing a combustion zone in the fragmented oil shale in the in situ oil shale retort;

introducing into said combustion zone, in the direction in which said combustion zone is to be advanced, a gaseous feed mixture comprising an oxygen supplying gas and water vapor at a rate sufficient to maintain the temperature in said combustion zone at a temperature higher than the retorting temperature of the oil shale in the in situ oil shale retort and to advance said combustion zone through the in situ oil shale retort, and producing combustion product gases in said combustion zone, and wherein said gaseous feed mixture is introduced into said combustion zone at from about 0.5 to about 1 Standard Cubic Foot per minute per square foot of cross-sectional area of the fragmented oil shale being retorted;

passing flue gas, comprising said combustion product gases and unreacted gaseous feed mixture gases, from the combustion zone through the fragmented oil shale in the in situ retort in the direction of the advancement of said combustion zone, thereby retorting oil shale in a retorting zone on the advancing side of said combustion zone to produce liquid and gaseous product; and withdrawing said liquid product and retort off gas comprising said gaseous products and said flue gas from the in situ oil shale retort on the advancing side of said retorting zone.

16. A method of recovering liquid and gaseous products from fragmented oil shale in an in situ oil shale retort in which a combustion zone is advanced therethrough, which comprises the steps of:

establishing a combustion zone in the fragmented oil shale in the in situ oil shale retort;

introducing into said combustion zone, in the direction in which said combustion zone is to be advanced, a gaseous feed mixture comprising an oxygen supplying gas and water vapor at a rate sufficient to maintain the temperature in said combustion zone at a temperature higher than the retorting temperature of the oil shale in the in situ oil shale retort and to advance said combustion zone through the in situ oil shale retort, and producing combustion product gases in said combustion zone, and wherein the temperature in said combustion zone is maintained at a temperature of from about 1100° F to about 1400° F;

passing flue gas, comprising said combustion product gases and unreacted gaseous feed mixture gases, from the combustion zone through the fragmented oil shale in the in situ retort in the direction of the advancement of said combustion zone, thereby retorting oil shale in a retorting zone on the advancing side of said combustion zone to produce liquid and gaseous product; and withdrawing said liquid product and retort off gas comprising said gaseous products and said flue gas from the in situ oil shale retort on the advancing side of said retorting zone.

17. A method of recovering liquid and gaseous products from fragmented oil shale in an in situ oil shale retort in which a combustion zone is advanced therethrough, which comprises the steps of:

establishing a combustion zone having a temperature higher than about 800° F in the oil shale in the in situ oil shale retort;

introducing downwardly into said combustion zone a gaseous feed mixture comprising sufficient oxygen supplying gas to provide a gaseous feed mixture having greater than about 5 percent by volume oxygen and from about 10 to about 90 percent by volume of water vapor, at a rate sufficient to maintain the temperature in said combustion zone at a temperature higher than about 800° F, and to advance said combustion zone through the in situ oil shale retort, thereby producing combustion product gases in said combustion zone;

passing flue gas, comprising said combustion product gases and unreacted gaseous feed mixture gases, from the combustion zone downwardly through the fragmented oil shale in the in situ oil shale retort, thereby retorting oil shale in a retorting zone on the advancing side of said combustion zone to produce liquid and gaseous products;

condensing water vapor on unretorted oil shale on the advancing side of the retorting zone to form liquid water; and withdrawing liquid water, said liquid product and retort off gas comprising said gaseous products and said flue gas from the in situ oil shale retort at a level below said retorting zone.

18. The method of claim 17 wherein said oxygen comprises from about 10 to about 15 percent by volume of said gaseous feed mixture.

19. The method of claim 17 wherein said oxygen comprises from about 12 to about 15 percent by volume of said gaseous feed mixture.

20. The method of claim 17 wherein said oxygen supplying gas is air.

21. The method of claim 17 wherein said gaseous feed mixture is introduced downwardly into said combustion zone at a rate sufficient to bring about the retorting of the oil shale on the advancing side of said combustion zone and produce retorted oil shale prior to the passage of said combustion zone therethrough.

22. The method of claim 17 wherein said gaseous feed mixture is introduced into said combustion zone at from about 0.1 to about 1 Standard Cubic Foot per minute per square foot of cross-sectional area of the in situ oil shale being retorted.

23. The method of claim 17 wherein said combustion zone is maintained at a temperature below the rapid decomposition temperature of calcium carbonate.

24. The method of claim 17 wherein said combustion zone is maintained at a temperature below about 1400° F.

25. The method of claim 17 wherein said combustion zone is maintained at a temperature of from about 950° F to about 1800° F.

26. A method of recovering liquid and gaseous products from fragmented oil shale in an in situ oil shale retort in which a combustion zone is advanced therethrough, which comprises the steps of:

establishing a combustion zone in the oil shale in the in situ oil shale retort;

introducing downwardly into said combustion zone a gaseous feed mixture comprising sufficient oxygen supplying gas to provide a gaseous feed mixture having greater than about 5 percent by volume oxygen and from about 10 to about 50 percent by volume of water vapor, at a rate sufficient to maintain the temperature in said combustion zone within a predetermined range of temperatures above the retorting temperature of the oil shale in the in situ oil shale retort, and to advance said combustion zone through the in situ oil shale retort, thereby producing combustion product gases in said combustion zone;

passing flue gas, comprising said combustion product gases and unreacted gaseous feed mixture gases, from the combustion zone downwardly through the fragmented oil shale in the in situ oil shale retort; thereby retorting oil shale in a retorting zone on the advancing side of said combustion zone to produce liquid and gaseous product; and withdrawing said liquid product and retort off gas comprising said gaseous product and said flue gas from the in situ oil shale retort at a level below said retorting zone.

27. A method of recovering liquid and gaseous products from fragmented oil shale in an in situ oil shale retort in which a combustion zone is advanced therethrough, which comprises the steps of:

establishing a combustion zone in the oil shale in the in situ oil shale retort;

introducing downwardly into said combustion zone a gaseous feed mixture comprising sufficient oxygen supplying gas to provide a gaseous feed mixture having greater than about 5 percent by volume oxygen and from about 20 to about 40 percent by volume of water vapor, at a rate sufficient to maintain the temperature in said combustion zone within a predetermined range of temperatures above the retorting temperature of the oil shale in the in situ oil shale retort, and to advance said combustion zone through the in situ oil shale retort, thereby producing combustion product gases in said combustion zone;

passing flue gas, comprising said combustion products gases and unreacted gaseous feed mixture gases, from the combustion zone downwardly through the fragmented oil shale in the in situ oil shale retort, thereby retorting oil shale in a retorting zone on the advancing side of said combustion zone to produce liquid and gaseous products; and withdrawing said liquid product and retort off gas comprising said gaseous products and said flue gas from the in situ oil shale retort at a level below said retorting zone.

28. A method of recovering liquid and gaseous products from fragmented oil shale in an in situ oil shale retort in which a combustion zone is advanced therethrough, which comprises the steps of:

establishing a combustion zone in the oil shale in the in situ oil shale retort;

introducing downwardly into said combustion zone a gaseous feed mixture comprising sufficient oxygen supplying gas to provide a gaseous feed mixture having greater than about 5 percent by volume oxygen and from about 10 to about 90 percent by volume of water vapor, at a rate sufficient to maintain the temperature in said combustion zone within a predetermined range of temperatures above the retorting temperature of the oil shale in the in situ oil shale retort, and to advance said combustion zone through the in situ oil shale retort, thereby producing combustion product gases in said combustion zone, and wherein said gaseous feed mixture is introduced into said combustion zone at from about 0.1 to about 2 Standard Cubic Feet per minute per square foot of cross-sectional area of the fragmented oil shale being retorted;

passing flue gas, comprising said combustion products gases and unreacted gaseous feed mixture gases, from the combustion zone downwardly through the fragmented oil shale in the in situ oil shale retort, thereby retorting oil shale in a retorting zone on the advancing side of said combustion zone to produce liquid and gaseous products; and withdrawing said liquid product and retort off gas comprising said gaseous products and said flue gas from the in situ oil shale retort at a level below said retorting zone.

29. A method of recovering liquid and gaseous products from fragmented oil shale in an in situ oil shale retort in which a combustion zone is advanced therethrough, which comprises the steps of:

establishing a combustion zone in the oil shale in the in situ oil shale retort;

introducing downwardly into said combustion zone a gaseous feed mixture comprising sufficient oxygen supplying gas to provide a gaseous feed mixture having greater than about 5 percent by volume oxygen and from about 10 to about 90 percent by volume of water vapor, at a rate sufficient to maintain the temperature in said combustion zone within a predetermined range of temperatures above the retorting temperature of the oil shale in the in situ oil shale retort, and to advance said combustion zone through the in situ oil shale retort, thereby producing combustion product gases in said combustion zone, and wherein said gaseous feed mixture is introduced into said combustion zone at from about 0.5 to about 1 Standard Cubic Foot per minute per square foot of cross-sectional area of the in situ oil shale being retorted;

passing flue gas, comprising said combustion product gases and unreacted feed mixture gases, from the combustion zone downwardly through the fragmented oil shale in the in situ oil shale retort, thereby retorting oil shale in a retorting zone on the advancing side of said combustion zone to produce liquid and gaseous products; and withdrawing said liquid product and retort off gas comprising said gaseous products and said flue gas from the in situ oil shale retort at a level below said retorting zone.

30. A method of recovering liquid and gaseous products from fragmented oil shale in an in situ oil shale retort in which a combustion zone is advanced therethrough, which comprises the steps of:

establishing a combustion zone in the oil shale in the in situ oil shale retort;

introducing downwardly into said combustion zone a gaseous feed mixture comprising sufficient oxygen supplying gas to provide a gaseous feed mixture having greater than about 5 percent by volume oxygen and from about 10 to about 90 percent by volume of water vapor, at a rate sufficient to maintain the temperature in said combustion zone within a predetermined range of temperatures above the retorting temperature of the oil shale in the in situ oil shale retort, and to advance said combustion zone through the in situ oil shale retort, thereby producing combustion product gases in said combustion zone, and wherein said combustion zone is maintained at a temperature of from about 1100° F to about 1400° F;

passing flue gas, comprising combustion product gases and unreacted gaseous feed mixture gases, from the combustion zone downwardly through the fragmented oil shale in the in situ oil shale retort, thereby retorting oil shale in a retorting zone on the advancing side of said combustion zone to produce liquid and gaseous products; and withdrawing said liquid product and retort off gas comprising said gaseous products and said flue gas from the in situ oil shale retort at a level below said retorting zone.

31. A method of recovering liquid and gaseous products from oil shale in an in situ oil shale retort in which a combustion zone is advanced therethrough, which comprises the steps of:

establishing a combustion zone in the oil shale in the in situ oil shale retort;

introducing downwardly into the in situ oil shale retort at a level above said combustion zone a gaseous feed mixture comprising from about 90 to about 50 percent by volume air and from about 10 to about 50 percent by volume water vapor at a rate sufficient to maintain the temperature in said combustion zone at a temperature higher than the retorting temperature of the oil shale in the in situ oil shale retort and to advance said combustion zone through the in situ oil shale retort, thereby producing combustion product gases in said combustion zone;

passing flue gas, comprising said combustion product gases and unreacted gaseous feed mixture gases downwardly through the fragmented oil shale in the in situ oil shale retort, thereby retorting the oil shale in a retorting zone on the advancing side of said combustion zone, to produce liquid and gaseous products;

condensing water vapor on unretorted oil shale on the advancing side of said retorting zone to form liquid water; and withdrawing liquid water, said liquid product and retort off gas comprising gaseous product and said flue gas from the in situ oil shale retort at a level below said retorting zone.

32. The method of claim 31 wherein oxygen provided by the air comprises from about 12 to about 15 percent by volume of said gaseous feed mixture.

33. The method of claim 31 wherein said water vapor comprises from about 20 to about 40 percent by volume of said gaseous feed mixture.

34. The method of claim 31 wherein said gaseous feed mixture is introduced downwardly into said combustion zone at a rate sufficient to bring about the retorting of the oil shale on the advancing side of said combustion zone to produce retorted oil shale prior to the passage of said combustion zone therethrough.

35. The method of claim 31 wherein said gaseous feed mixture is introduced into said combustion zone at from about 0.1 to about 2 Standard Cubic Feet per minute per square foot of cross-sectional area of the in situ oil shale being retorted.

36. The method of claim 31 wherein said gaseous feed mixture is introduced into said combustion zone at from about 0.1 to about 1 Standard Cubic Foot per minute per square foot of cross-sectional area of the in situ oil shale being retorted.

37. The method of claim 1 wherein said gaseous feed mixture is introduced into said combustion zone at from about 0.5 to about 1 Standard Cubic Foot per minute per square foot of cross-sectional area of the in situ oil shale being retorted.

38. The method of claim 1 wherein said combustion zone is maintained at a temperature lower than the rapid decomposition temperature of the carbonates in said oil shale.

39. The method of claim 1 wherein the temperature in said combustion zone is maintained at a temperature of from about 950° F to about 1800° F.

40. The method of claim 1 wherein the temperature in said combustion zone is maintained at a temperature of from about 1100° F to about 1600° F.

41. The method of claim 1 wherein the temperature in said combustion zone is maintained at a temperature of from about 1100° F to about 1400° F.

42. The method of claim 1 wherein the temperature in said combustion zone is maintained at a temperature of from about 1200° F to about 1300° F.

43. A method of recovering liquid and gaseous products from fragmented oil shale in an in situ oil shale retort in which a combustion zone is advanced therethrough, which comprises the steps of:

establishing a combustion zone in the oil shale in the situ oil shale retort;

introducing downwardly into the in situ oil shale retort at a level above said combustion zone, at about 0.5 to about 1 Standard Cubic Foot per minute per square foot of cross-sectional area of the in situ oil shale being retorted, a gaseous feed mixture comprising from about 60 to about 70 percent by volume air and from about 40 to about 30 percent by volume water vapor for producing combustion product gases in said combustion zone which together with unreacted gases in said feed mixture comprise flue gas which passes downwardly through the in situ oil shale retort, thereby retorting the oil shale in a retorting zone on the advancing side of said combustion zone, to produce liquid and gaseous products;

condensing water vapor on unretorted oil shale on the advancing side of said retorting zone;

withdrawing liquid water, said liquid products and retort off gas comprising said gaseous products and said flue gas from the in situ oil shale retort at a level below said retorting zone; and vaporizing at least a portion of said withdrawn water to produce said water vapor and mixing said water vapor with air to produce a gaseous feed mixture and introducing said into a retort at a level above a combustion zone.

44. The method of claim 43 wherein said combustion zone is maintained at a temperature lower than the rapid decomposition temperature of carbonates in the oil shale.

45. The method of claim 43 wherein the temperature in said combustion zone is maintained at a temperature of from about 1100° F to about 1400° F.

46. The method of claim 43 wherein the temperature in said combustion zone is maintained at a temperature of from about 1200° F to about 1300° F.

47. The method of claim 45 wherein the temperature in said combustion zone is maintained at a temperature of from about 800° F to about 1800° F.

* * * * *

UNITED STATES PATENT AND TRADEMARK OFFICE

CERTIFICATE OF CORRECTION

PATENT NO. : 4,036,299

DATED : July 19, 1977

INVENTOR(S) : Chang Yul Cha, Richard D. Ridley

It is certified that error appears in the above-identified patent and that said Letters Patent are hereby corrected as shown below:

Column 3, line 65, "Aplication" should be -- Application --.
Column 4, line 24, "of" (first occurrence) should be -- or --.
Column 9, line 24, "gaseious" should be -- gaseous --;
line 38, "vaor" should be -- vapor --.
Column 11, line 34, "shown" should be -- show --.
Column 13, line 34, "advancinng" should be -- advancing --.
Column 14, line 29, -- oil -- should be inserted after "situ" and before "shale";
line 68, "uneacted" should be -- unreacted --.

line 48, "products" should be -- product --.
Column 18, line 14, "products" should be -- product --;
line 49, -- gaseous -- should be inserted after "unreacted" and before "feed".
Column 19, line 11, -- said -- should be inserted after "comprising" and before "combustion";
line 50, -- said -- should be inserted after "comprising" and before "gaseous".

UNITED STATES PATENT AND TRADEMARK OFFICE

CERTIFICATE OF CORRECTION

PATENT NO. : 4,036,299

DATED : July 19, 1977

INVENTOR(S) : Chang Yul Cha, Richard D. Ridley

It is certified that error appears in the above-identified patent and that said Letters Patent are hereby corrected as shown below:

Column 20, line 6, "1" should be -- 31 --;
line 10, "1" should be -- 31 --;
line 14, "1" should be -- 31 --;
line 17, "1" should be -- 31 --;
line 20, "1" should be -- 31 --;
line 23, "1" should be -- 31 --;
line 47, "products" should be -- product --;
line 54, "said" should be -- same --;
line 65, "45" should be -- 43 --.

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademark*